United States Patent [19]

Bartels

[11] 4,065,164

[45] Dec. 27, 1977

[54] FIRE-SAFE LEVER HANDLE

[75] Inventor: Vernon A. Bartels, Alameda, Calif.

[73] Assignee: Schlage Lock Company, San Francisco, Calif.

[21] Appl. No.: 745,358

[22] Filed: Nov. 26, 1976

[51] Int. Cl.[2] ..... E05C 21/00

[52] U.S. Cl. ..... 292/347; 292/348

[58] Field of Search ..... 292/347, 348; 49/1, 49/460; 160/1

[56] References Cited

U.S. PATENT DOCUMENTS

| | | | |
|---|---|---|---|
| 205,061 | 6/1878 | Dickerman | 292/348 |
| 1,524,485 | 1/1925 | McIntosh | 49/1 |
| 2,160,611 | 5/1939 | Alexander | 292/348 |

*Primary Examiner*—Richard E. Moore

*Attorney, Agent, or Firm*—Lothrop & West

[57] ABSTRACT

A fire-safe lever handle is for use with a lock having a bolt retractable by rotation of a spindle about an axis. The lever handle has a center of gravity off of said axis and has a hub surrounding the spindle. Disposed between the hub and the spindle is a body of meltable or fusible material, such as lead. Under ordinary temperatures the fusible material is solid and connects the spindle and hub for rotation together about the axis. Under fire conditions, the fusible or meltable material melts and disconnects the hub from the spindle so that a fire fighting water jet impinging against the lever handle cannot rotate the spindle and retract the bolt. A drain in the hub releases the melted material from the interior of the hub and permits the hub freely to rest on the spindle at a downwardly inclined angle. This assures that the melted material does not resolidify and reconnect the hub and spindle.

10 Claims, 4 Drawing Figures

FIG-1
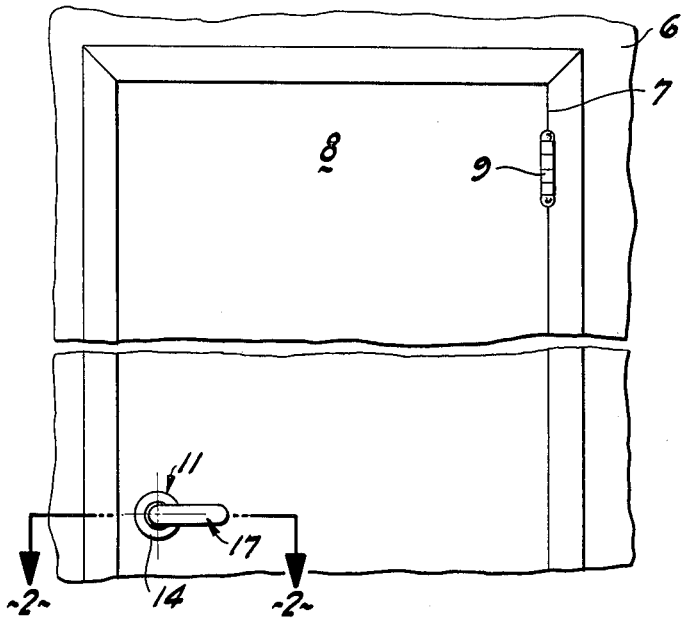
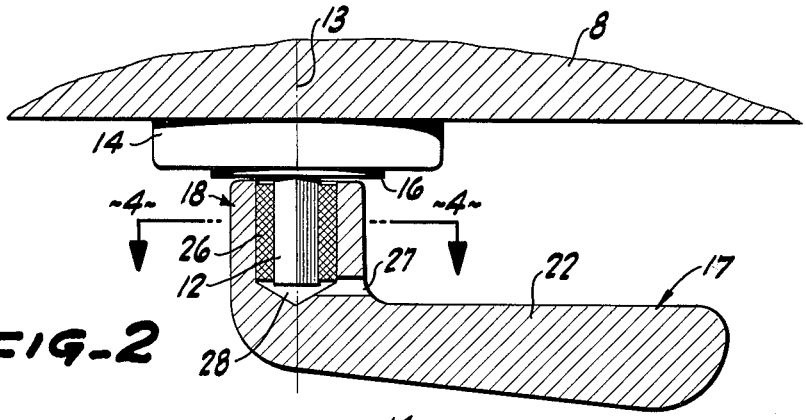
FIG-2
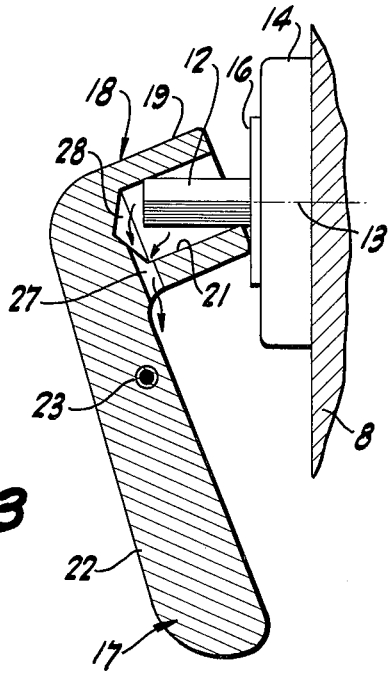
FIG-3
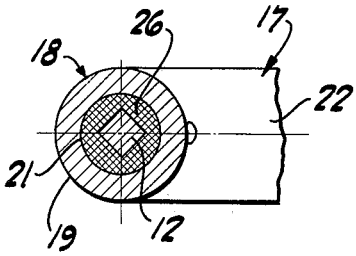
FIG-4

FIRE-SAFE LEVER HANDLE

BRIEF SUMMARY OF THE INVENTION

A door lock having a rotary spindle to retract the bolt is provided with an eccentric handle; that is, one having its center of gravity off of the spindle axis. The handle has a hub surrounding the spindle with a body of fusible or meltable material, such as lead, between the interior of the hub and the spindle. Under normal temperatures the handle and spindle move together about the axis. Under fire temperatures the meltable material or lead liquifies and is able to run out of a drain hole extending between the inside and the outside of the hub. The melted material runs out of and away from the hub. The arrangement is preferably such that the center of gravity of the so disconnected or freed handle lies beneath the spindle axis and the hub is supported but canted at a downward slant.

BRIEF DESCRIPTION OF THE SEVERAL VIEWS OF THE DRAWING

FIG. 1 is an elevation of a standard door, the door panel being provided with a lock having the fire-safe lever handle of the invention, portions of the figure being broken away to reduce its size.

FIG. 2 is a cross-section to an enlarged scale, the plane of section being indicated by the line 2—2 of FIG. 1.

FIG. 3 is a side elevation, with some portions in section, showing the device after experiencing a fire temperature.

FIG. 4 is a cross-section, the plane of which is indicated by the line 4—4 of FIG. 2.

DETAILED DESCRIPTION

It is customary to provide doors with locks having movable bolts operated by some sort of a handle convenient for manipulation. Customarily, a round knob is utilized under many circumstances, and in other circumstances a lever handle is utilized. In considering the function of a door under fire conditions, it is the preference or even a requirement that the door remain with its bolt projected and so held closed during a fire, to prevent spreading. Often, in fighting the fire a jet of water is directed against the door and may impinge upon the door handle. If the handle is simply a circular concentric knob, there is often little effect by the water jet to open the lock. But if the lock is equipped with a lever handle, then it is possible for the fire fighting water jet to impinge upon the lever handle with sufficient force and in a proper direction to cause retraction of the bolt and to release the door to open, contrary to the desires and requirements.

It is an object of the invention to provide a lever handle that is so arranged that the lock bolt remains projected despite impingement of a water jet against the lever handle.

Another object of the invention is to provide a knob or lever handle that can be released by high temperature conditions from its ability to operate the lock.

A further object of the invention is to provide a handle that once released by high temperature remains released even though the temperature may subsequently drop to normal values.

A further object of the invention is to provide a lever handle having releasing capabilities, yet which can be readily utilized with lock sets of generally standard construction.

A further object of the invention is to provide an improved handle releasable from the lock mechanism under high temperature conditions.

Other objects will appear from the accompanying drawings and from the following description.

While there are many variations that can be employed within the ambit of the present invention, the version illustrated herein has been constructed, tested and successfully operated. In the present environment, there is a building wall 6 having a door frame 7 defining an opening normally closed by a door panel 8 mounted on hinges 9 in the customary fashion.

To secure the door in its closed position, there is afforded a lock set 11 not illustrated in detail but of the customary sort in which a bolt (not shown) projects from the door panel 8 into the door frame 7 to hold the door closed. The bolt is operated by rotation of a spindle 12 about an axis 13. That is, in the normal rest position of the spindle 12, the bolt, whether a deadbolt or a latchbolt, is projected. Upon rotation of the spindle 12 about the axis 13 either in one direction or in the opposite direction, the bolt is retracted or withdrawn to release the door panel 8 from its surrounding frame 7 and to permit the door panel to swing open.

It is customary for mounting and trim purposes to surround the spindle 12 by a rosette 14 and an integral or separate thrust washer 16. These are normally secured together and are fastened to the door panel.

The spindle 12 can be of any desired configuration in cross-section, sometimes circular and sometimes polygonal. In the present instance the spindle projects a substantial distance from the face of the thrust washer 16 and preferably has a square cross-section, as indicated in FIG. 4.

Particularly pursuant to the invention, the spindle, which can normally take standard knobs or levers, is in the present instance provided with a special lever handle generally designated 17. While the present arrangement can be of some benefit if a circular knob is used, it is of most benefit with a lever handle and so, without limitation, is so described. The lever handle 17 preferably is an integral casting of metal or may be formed of other materials able to withstand relatively high temperatures, perhaps of the order of 1600° F. The lever handle preferably includes a hub 18. The hub may have a circular cylindrical outer surface 19 and a somewhat similar circular cylindrical inner surface 21, both symmetrical about the axis 13 when the handle is in normal operating position. Furthermore, the handle is normally extended horizontally to one side of the axis 13 to provide a lever portion 22 adapted to be grasped by hand and rotated. The general arrangement is such that the center of gravity of the handle and hub combination, as shown in FIG. 3, is located, under certain special conditions, at a point 23 in the vertical plane of the axis 13 and directly below the spindle 12 itself.

Interposed between the hub and the spindle is a body 26 of a special meltable or fusible material. While there is a wide range of materials that can be utilized, it has been found that some of the head alloys are satisfactory since they normally maintain a sufficient connection by interengagement and by friction both with the spindle 12 and with the interior of the hub 18. Under normal conditions, rotation of the handle and hub about the axis 13 causes a conjoint rotation of the spindle 12 and vice versa. While the interconnection between the body 26 and the spindle 12 may be so intimate as not to require any other fastening, there may also be some sort of meltable fastening (not shown) also engaging the hub and the spindle.

The body 26 has the ability to melt at a predetermined temperature and to liquify substantially simultaneously in all parts.

There has been previous experience with some melting bodies. When the melted body was impacted by a water jet, during firefighting, for example, the metal again solidified since its temperature was sufficiently lowered. The resolidified body reconnected the spindle and the hub well enough to permit a water jet impinging on the handle 17 to retract the bolt.

To preclude this unfortunate operation, the present arrangement includes means forming a drain from the interior of the hub to the exterior thereof. In the present instance, this means is in the form of a drain passage 27 extending radially from the interior surface 21 of the hub to the exterior surface 19 thereof. The drain 27 conveniently intersects the conical end chamber 28, which may have been formed in the hub by drilling or the like, so that there is always an open passageway between the interior of the hub and the exterior of the handle.

While normally the handle is substantially horizontal, as shown in FIGS. 1 and 2, so that the drain 27 itself is substantially horizontal, what happens when the temperature is increased to a high value is that the material of the body 26 melts. As soon as the material melts, or even as it is melting, the frictional restraint between the material and the interior 21 of the hub is dissipated. The force of gravity acting in effect at the center of gravity 23 causes the handle 22 to rotate downwardly. The handle then hangs vertically with the center of gravity 23 vertically below the axis 13. This action makes the drain 27 assume a substantially vertical posture. The melted material of the body 26 flows by gravity generally in a downward direction and out the drain 27, leaving the interior of the hub substantially void. The melted material, being conducted outside the handle and completely away from the rosette 14 or other parts of the lock set, is innocuously disposed of and cannot cause jamming.

Since there is no longer any support for the handle on the spindle, the handle tends to droop, as shown in FIG. 3, with the center of gravity 23 establishing itself not only vertically below the axis 13, but also below the end or tip of the spindle. The drain passage 27 is still nearly vertical. The handle is generally supported, but is ineffective to produce any torque whatsoever on the spindle 12. The circular inner hub surface 21 can itself exert no torque on the square spindle 12. A jet water stream tends merely to dislodge the handle.

Under these circumstances, if a water jet then impinges upon the lock mechanism, there is no longer any fusible or meltable material within the hub and there is nothing then to resolidify and reconnect the hub and the spindle. While a water jet may under those conditions rotate the handle, there can be no torque transmitted to retract the bolt. The jet stream may dislodge the released handle from the spindle, but that is an unimportant factor. Should the handle subsequently be retrieved and still be considered useful, it can be reconstituted by providing another meltable body 26 or bushing.

There is thus provided a fire-safe lever handle that can operate indefinitely under normal circumstances, but upon the occasion of a fire or a sufficiently high ambient temperature to cause melting of the meltable or fusible body 26 will become disconnected immediately from the spindle with the melted interconnection being dissipated, so that there can be no reconnection without reconstruction of the handle.

I claim:

1. A fire-safe lever handle comprising a lock spindle, means for supporting said spindle for rotation about a horizontal axis, a lever handle having a center of gravity off of said axis, a hub on said lever handle, a meltable material when solid interposed between and engaging said hub and said spindle against relative rotation, and means on said lever handle forming a drain for said material when melted.

2. A device as in claim 1 in which said means forming a drain is substantially vertical when said center of gravity is vertically beneath said axis.

3. A device as in claim 1 in which said means forming a drain is an open passage extending from the interior of said hub to the exterior thereof.

4. A device as in claim 1 in which said center of gravity is disposed substantially below said spindle when said meltable material is melted.

5. A device as in claim 4 in which said hub is inclined downwardly and said means forming a drain is at the low point thereof.

6. A fire-safe lever handle comprising a hub symmetrical about an axis, a lever handle extending eccentrically from said axis, and a meltable material lining said hub.

7. A device as in claim 6 in which said lining has a shape adapted to interfit with a spindle.

8. A device as in claim 6 including a drain through the wall of said hub in a generally radial direction.

9. In a lock set having a bolt retractable by rotation of a lock spindle about an axis and having a handle rotatable around said spindle and about said axis by an impinging jet of water, a meltable interconnection between said spindle and said handle effective to couple said spindle and said handle for rotation together at normal temperatures and effective to uncouple said spindle and said handle at fire temperatures.

10. A device as in claim 9 in which said handle has a center of gravity movable between one position to one side of said axis and another position below said axis, and a drain through said handle between and substantially in alignment with said axis and said center of gravity and below said axis when said spindle and said handle are uncoupled.

* * * * *